US009486380B2

(12) United States Patent
Jensen et al.

(10) Patent No.: US 9,486,380 B2
(45) Date of Patent: Nov. 8, 2016

(54) LIGHTWEIGHT ABSORBENT BODY BAG

(75) Inventors: Ronald Jensen, Chicago, IL (US); Richard Beu, Yorba Linda, CA (US); Sayandro Versteylen, Ontario, CA (US)

(73) Assignee: Paper-Pak Industries, Laverne, CA (US)

( * ) Notice: Subject to any disclaimer, the term of this patent is extended or adjusted under 35 U.S.C. 154(b) by 235 days.

(21) Appl. No.: 12/741,331

(22) PCT Filed: Nov. 5, 2008

(86) PCT No.: PCT/US2008/082525
§ 371 (c)(1),
(2), (4) Date: May 4, 2010

(87) PCT Pub. No.: WO2009/061850
PCT Pub. Date: May 14, 2009

(65) Prior Publication Data

US 2010/0263178 A1 Oct. 21, 2010

Related U.S. Application Data

(60) Provisional application No. 61/001,885, filed on Nov. 5, 2007.

(51) Int. Cl.
*A61G 17/06* (2006.01)
*A61G 17/007* (2006.01)

(52) U.S. Cl.
CPC ..... *A61G 17/06* (2013.01); *A61G 17/007* (2013.01); *A61G 2203/90* (2013.01)

(58) Field of Classification Search
CPC .. A61G 17/06; A61G 7/1055; A61G 17/007; A61G 2203/90; B65D 33/08; B65D 33/2591; B65D 75/225
USPC ..... 27/28; 383/66; 493/186, 212–214, 217, 493/226
See application file for complete search history.

(56) References Cited

U.S. PATENT DOCUMENTS 4,742,821 A 5/1988 Wootan
4,780,940 A * 11/1988 Jay ..... 27/28
4,790,040 A * 12/1988 Grilliot et al. ..... 5/413 R
4,790,051 A * 12/1988 Knight ..... 27/28
(Continued)

FOREIGN PATENT DOCUMENTS

WO 9503769 A2 2/1995

OTHER PUBLICATIONS

International Search Report mailed Dec. 23, 2008 for the corresponding PCT/US2008/082525.
(Continued)

*Primary Examiner* — William Miller
(74) *Attorney, Agent, or Firm* — Ohlandt, Greeley, Ruggiero & Perle, LLP

(57) ABSTRACT

The present disclosure is a lightweight, absorbent body bag. The body bag is portable and disposable. The body bag has a backing substrate, an absorbent body, a cover with a recloseable flap that can be opened and closed to permit a body to be placed within and removed from the body bag, and gripping devices along the edges to permit easy transportation. A thermal seal may be applied continuously along a perimeter of the body bag to create a water-resistant body compartment. The present disclosure also includes a method for using the body bag and a body bag kit.

28 Claims, 15 Drawing Sheets

(56) References Cited

U.S. PATENT DOCUMENTS

| | | | | |
|---|---|---|---|---|
| 4,922,562 | A * | 5/1990 | Allred et al. | 5/627 |
| 5,341,548 | A | 8/1994 | Zerick | |
| 5,659,933 | A | 8/1997 | McWilliams | |
| 5,715,583 | A * | 2/1998 | Sandoval | 27/11 |
| 6,004,034 | A * | 12/1999 | Salam | 383/66 |
| 7,228,603 | B2 * | 6/2007 | Craig | 27/28 |
| 7,337,511 | B2 * | 3/2008 | Yu et al. | 27/28 |
| 7,484,275 | B2 * | 2/2009 | Carroll et al. | 27/28 |
| 2002/0147433 | A1 | 10/2002 | McCosker et al. | |
| 2004/0252918 | A1 | 12/2004 | Yu et al. | |
| 2007/0029761 | A1 | 2/2007 | Darling | |
| 2009/0118562 | A1 * | 5/2009 | Cole et al. | 588/313 |
| 2011/0162178 | A1 * | 7/2011 | Jensen et al. | 27/28 |

OTHER PUBLICATIONS

Canadian Office Action dated Apr. 30, 2013 for Canadian patent No. 2,704,566.

European Search Report dated Oct. 16, 2013 for European application No. 08848421.7.

* cited by examiner

LIGHTWEIGHT ABSORBENT BODY BAG

CROSS-REFERENCE TO RELATED APPLICATIONS

This application is the National Stage of International Application No. PCT/US2008/082525, filed Nov. 5, 2008, which claims benefit of, and priority to, U.S. Provisional Application No. 61/001,885, filed Nov. 5, 2007.

BACKGROUND OF THE INVENTION

1. Field of Invention

The present disclosure is a lightweight, absorbent body bag for holding and carrying a human and animal body after death. The body bag is portable and disposable. The body bag has a backing substrate, an absorbent body that absorbs blood and other body fluids, a cover with a recloseable flap to enclose the body and conceal it from public view, and a gripping device for ease of carrying. The body bag can contain active agents that reduce contamination and/or odors. A method of using the body bag is also disclosed.

2. Description of the Related Art

When a human has died, the decedent's body (also called the corpse or remains) is often enclosed in a body bag for transportation. The function of a body bag is to enclose the decedent's body and conceal it from public view, and to permit transportation with minimal physical contact between the carriers and the decedent's body.

The body bag must be strong enough to hold the weight of a human body without breaking, even when transported over a great distance or exposed to inclement weather. The body bag should be sufficiently large to completely encompass the body yet be sufficiently lightweight so as to be readily portable.

With many conventional body bags, leakage of the decedent's body fluids outside of the body bag is a disadvantage, as body fluids can contaminate the bearers or the surfaces on which the body bag rests. The leakage of large amounts of body fluids in the body bag can also weaken the integrity of conventional body bags, potentially causing the body bag to stretch, or even break, when carried. If a body bag is constructed with a weak design, the bearers themselves may have to support the weight of the decedent's body by placing their hands under the body bag beneath his body, making transportation of the body bag more difficult.

A decedent's body may decompose more quickly in a body bag because of microorganisms that are present within the body or from environmental sources. Also, the decedent's body may be continually re-contaminated by blood or other body fluids in a conventional body bag.

Thus, there is a need for a body bag that addresses these disadvantages of conventional body bags.

SUMMARY OF THE INVENTION

The present disclosure provides an absorbent, lightweight body bag for enclosing and transporting a deceased human or other animal body. The body bag is durable, portable, and disposable after use.

The body bag has an absorbent body that is able to absorb large amounts of blood and other body fluids from the decedent's body, to reduce the risk of contamination, and to provide a less-messy way to dispose of the body bag after use.

The present disclosure further provides that the body bag may also contain an active agent that reduces odor from the decedent's body and risk of re-contamination by blood and other body fluids exuded from the body.

The body bag of the present disclosure can have a thermal seal around a perimeter to form a body compartment that is water-resistant/fluid-resistant for placing a decedent's body.

The body bag of the present disclosure has a backing substrate, an absorbent body positioned on the backing substrate, a gripping device, a cover, and a recloseable flap in the cover with closures. Gripping devices can be cutouts or straps such that the body bag can be lifted by hand, or carried by inserting poles. Gripping devices can be reinforced and sized for comfort.

Also disclosed are body bags having the same components but smaller outer dimensions, for use for decedents who are children or smaller adults. Smaller body bags may also be used for holding detached body parts, such as after autopsy.

Also disclosed are body bags that have outer dimensions suitable for animals other than humans, such as dogs, cats, birds, research animals, and farm animals.

Also disclosed is a body bag kit that includes a body bag of the present disclosure and a separate water-resistant case to enclose the body bag, for ease of storage and greater portability.

Also disclosed is a method of using a body bag of the present disclosure, as well as methods for its manufacture.

DETAILED DESCRIPTION OF THE INVENTION

Figure 1:
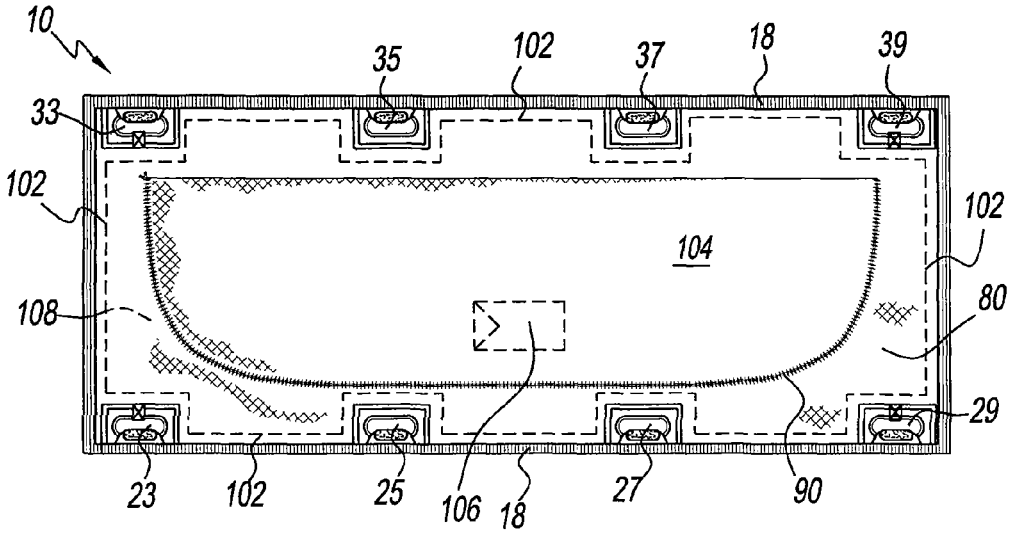
FIG. 1 illustrates a plan view of an exemplary embodiment of a body bag of the present disclosure.

Referring now to the drawings and, in particular, FIGS. 1 through 7, there is presented a body bag of the present disclosure generally represented by reference numeral 10. FIG. 1 illustrates a plan view of body bag 10. Body bag 10 has a cover 80. Cover 80 includes a closure 90. Body bag 10 has one or more gripping devices 23, 25, 27, and 29 along one side of body bag 10, and their corresponding one or more gripping devices 33, 35, 37, and 39, respectively, along the opposite side of body bag 10. Cover 80 includes a recloseable flap 104 that can be opened to provide access to the interior of body bag 10 for a body to be placed therein. Recloseable flap 104 is closed in FIG. 1.

Body bag 10 has one or more gripping device. As shown in the embodiment in FIG. 1, gripping devices 23, 25, 27, 29 are along one side of body bag 10, and gripping devices 33, 35, 37, 39 are along the opposite side of body bag 10. Binder 18 can be connected at one or more edges at the perimeter of body bag 10. Body bag 10 can optionally have a thermal seal 102 around the perimeter of the body bag, thereby forming a body compartment 108 inside of body bag 10 having a continuous seal to make body compartment partially or completely water- and fluid-resistant. Body bag 10 can also have one or more pocket 106 for storing documents.

Figure 2:
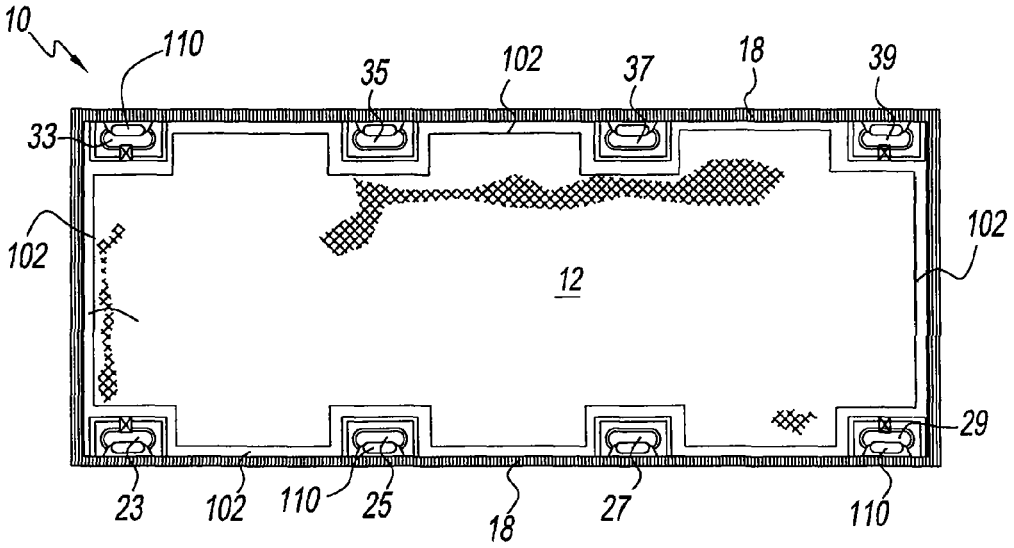
FIG. 2 illustrates a bottom side view of the body bag of FIG. 1.

FIG. 2 illustrates a bottom side view of body bag 10. Body Bag 10 has a backing substrate 12 that forms the back surface of the body bag. Backing substrate 12 has a first side and a second side, wherein the first side faces the top side of body bag 10, and the second side is a bottom side of said backing substrate 12. The second (bottom) side of backing substrate 12 is shown in FIG. 2. Body bag 10 has a reinforced piece 110 for gripping devices 23, 25, 27, 29, 33, 35, 37, 39, to reinforce the gripping devices and provide greater comfort while carrying body bag 10. Binder 18 and thermal seal 102 are shown in FIG. 2.

Figure 3:
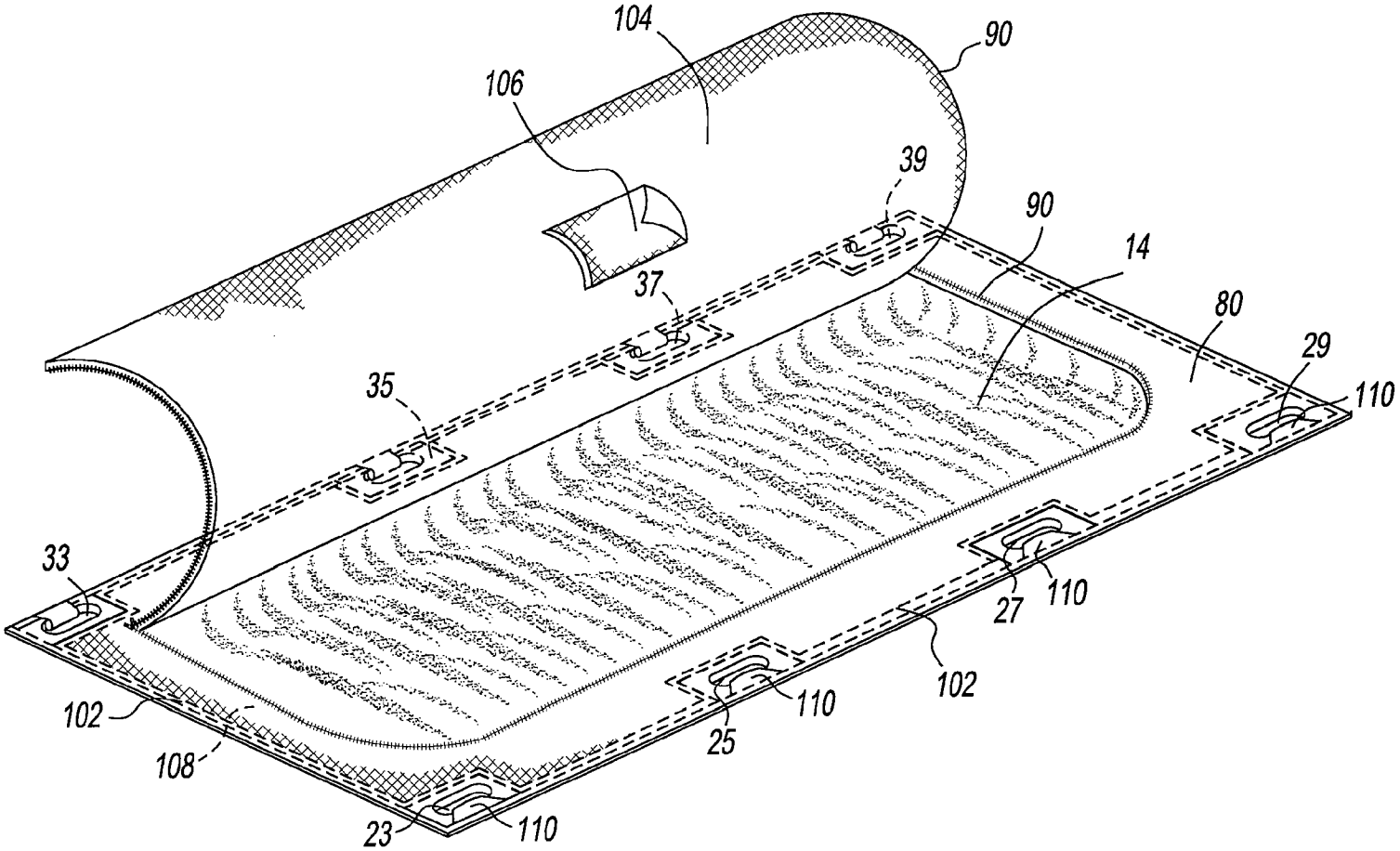
FIG. 3 illustrates a plan view of the body bag in FIG. 1 (recloseable flap open).

FIG. 3 illustrates body bag 10 with cover 80 and recloseable flap 104 in an open position, exposing absorbent body 14 in an interior of body bag 10. In FIG. 3, closure 90 is a zipper in an envelope-style ("D-shape") configuration in an unfastened condition, where one part of closure 90 is along the edge of recloseable flap 104 and the other part of closure 90 remains on cover 80. Body bag 10 can have a pocket 106 located on any surface, which is shown in FIG. 3 on the underside of recloseable flap 104. Pocket 106 can be used to hold documents or personal items of the decedent. FIG. 3 also shows body bag 10 with gripping devices 23, 25, 27, 29, 33, 35, 37, 39, and a reinforcement piece 110 for each gripping device.

As illustrated in FIGS. 1 to 3, body bag 10 includes a backing substrate 12, an absorbent body 14 connected to a first side of backing substrate 12 and being sized less than the backing substrate so that a portion of the backing substrate forms an edge about a portion of the absorbent body. Body bag 10 also has a cover 80 connected to the backing substrate. Cover 80 has a recloseable flap 104 to open and close, thereby providing access or precluding access, respectively, to the interior of the body bag. Body bag 10 has closure 90 along cover 80 and/or recloseable flap 104 to open and close the recloseable flap. Body bag 10 has a gripping device along the perimeter of the body bag. Body bag 10 completely encloses, and conceals from public view, a decedent's body placed therein when recloseable flap 104 is closed with closure 90. Closure 90 and recloseable flap 104 can be opened to permit a decedent's body to be placed in, or removed from, body bag 10.

Figure 4:
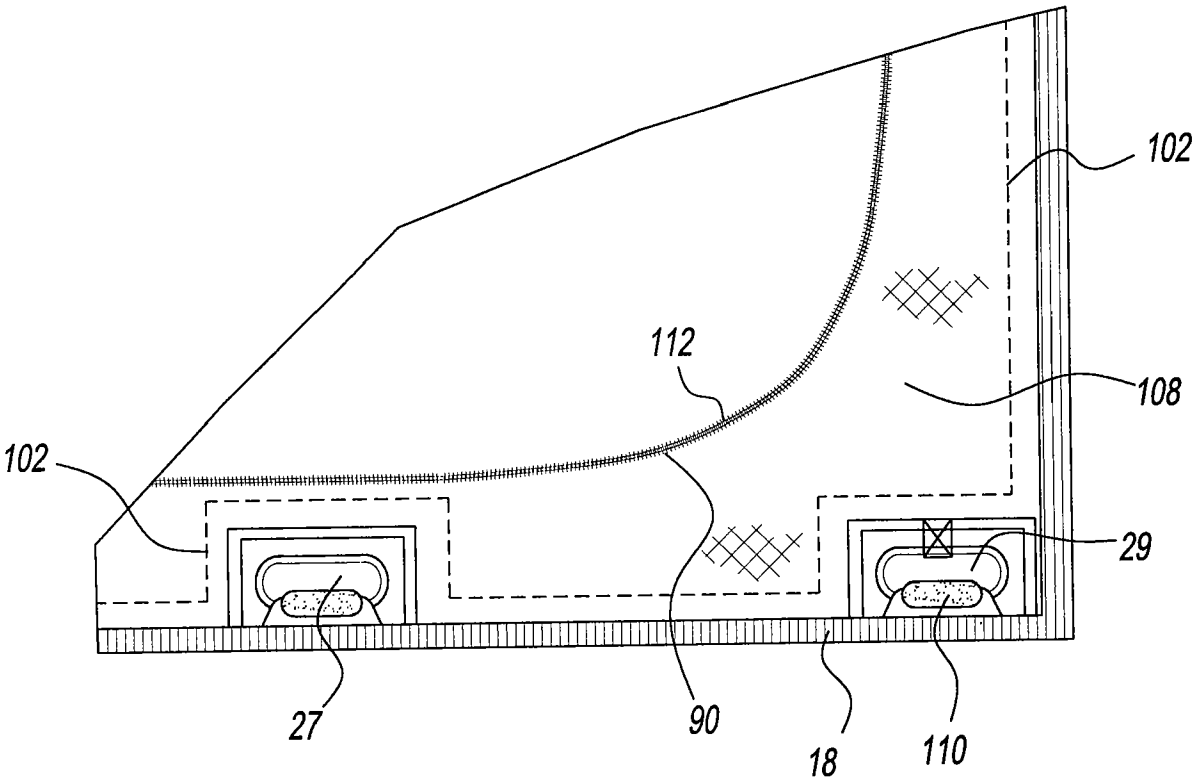
FIG. 4 shows a reinforced gripping device in the embodiment of the body bag in FIGS. 1 to 3.

FIG. 4 shows a close up view of gripping device 27, 29, with a reinforcing piece 110. FIG. 4 also shows an embodiment where closure 90 is a zipper that has a sealing material 112 along its length to provide water-resistance to closure 90. Body bag 10 has one or more gripping device 23, 25, 27, 29, 33, 35, 37, 39 that are connected to backing substrate 12. Gripping device 23, 25, 27, 29, 33, 35, 37, 39 can be a pass-through hole (as illustrated in FIG. 4), straps, eyelet loops, or any other device for one or more bearers to grip and transport body bag 10. For greater comfort or ease of carrying body bag 10, such as when the bearers are wearing safety gloves, gripping devices 23, 25, 27, 29, 33, 35, 37, 39 can be proportionately larger than shown in FIG. 4 to allow more room for the hand of the bearer. FIG. 4 also shows a portion of thermal seal 102 along a perimeter of body bag 10 and is contoured around a gripping device 27, so that the gripping device 23, 25, 27, 29, 33, 35, 37, 39 is external to the body compartment 108 formed by thermal seal 102. FIG. 4 also shows a portion of binder material 18 along an outer edge of body bag 10.

Figure 5:
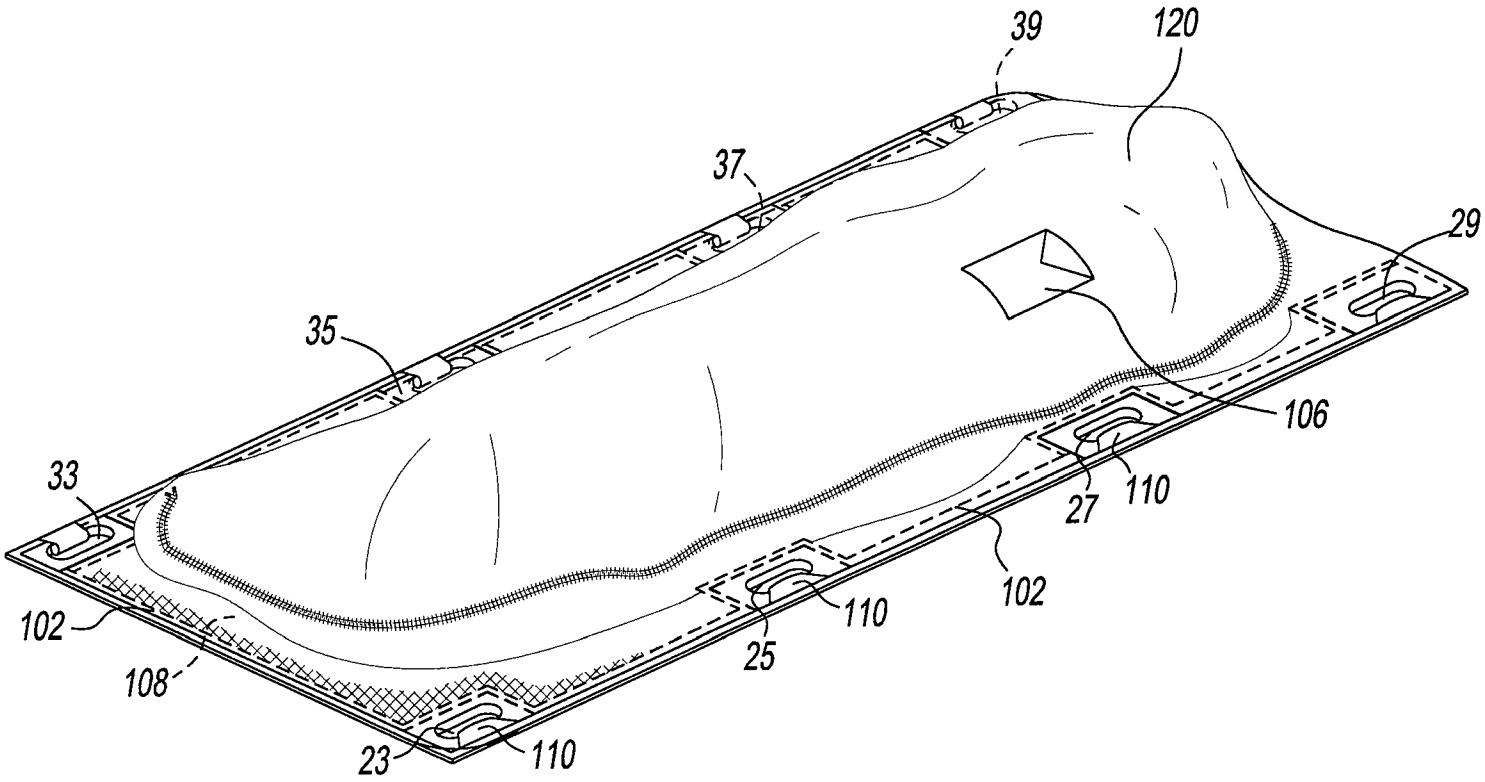
FIG. 5 illustrates the body bag of FIG. 1 with a decedent's body therein.

FIG. 5 illustrates an embodiment of body bag 10 with a decedent's body 120 placed therein. FIG. 5 also shows gripping device 23, 25, 27, 29, 33, 35, 37, and 39. In this embodiment, pocket 106 is shown on the external surface of cover 80, but can also be on the inside surface, particularly if pocket 106 is made of a water-resistant material. FIG. 5 also shows thermal seal 102, and indicates body compartment 108 (in the interior of body bag 10) that is formed by thermal seal 102

Cover 80 is positioned on the top of body bag 10 and is connected to backing substrate 12. Cover 80 is intended to conceal a decedent's body that is placed inside body bag 10, and also provides system integrity for the entire body bag. Cover 80 can one or more pieces of material that is shaped and sized to join together on top of body bag 10 to form a tent-like interior in body bag 10 in which a decedent's body can be placed to be completely enclosed and concealed from public view. Cover 80 is preferably made of one or more materials that exhibit weather resistance, water resistance, fatigue resistance, chemical resistance, and/or resistance to puncture or tearing. Cover 80 can be connected to backing substrate 12 at a portion of the backing substrate that forms an edge about a portion of absorbent body 14. Alternatively, cover 80 can be connected to backing substrate 12 at an outer edge of body bag 10, by an adhesive material, by forming a thermal weld between cover 80 and backing substrate 12, or by sewing. In one embodiment of body bag 10, cover 80 and backing substrate 12 are connected under binder material 18, to give body bag 10 complete integrity, and to provide a finished appearance.

Cover 80 can be a material selected from nylon, polymer (such as polypropylene or polyethylene), plastic, polyester, polyester blend, cloth (such as canvas, hemp, flax, or cotton fiber), or combinations of these materials. A preferred embodiment of cover 80 is made of nylon, including treated nylon. Another preferred embodiment of cover 80 is made of polyethylene or polypropylene. An alternative embodiment of cover 80 is made of cotton or canvas, including treated canvas.

Cover 80 is connected to backing substrate 12. Cover 80 is connected to the backing substrate by an adhesive material, thread (i.e., sewn together), or by welding treated materials that make up cover 80 and backing substrate 12.

Thermal bonding can be used to form a continuous thermal seal 102 around the periphery of body bag 10, to form a body compartment 108 in body bag 10 that is self-contained and water-resistant/fluid-resistant. A preferred technique for thermal bonding is Radio Frequency (RF) welding technology. Alternatively, ultrasonic bonding or heat bonding techniques can be used to create thermal seal 102. Thermal bonding can be achieved by melting a thermal bonding agent that is applied to backing substrate 12 and cover 80, creating a seam for a thermal bond that is between about one-quarter (¼) inch to about one (1) inch, and preferably about one-half (½) inch to about three-quarter (¾) inch, in a continuous segment around body bag 10 to form body compartment 108. An embodiment of the technique uses a coating that is applied to a portion of backing substrate 12 and to cover 80 to create the thermal bond, including, but is not limited to, a urethane coating.

Backing substrate 12 forms part or all of the back side of body bag 10. Backing substrate 12 preferably covers the entire back surface of body bag 10, and can be folded at the ends to form a portion of the backing substrate that forms an edge about a portion of absorbent body 14. Backing substrate 12 provides support, ruggedness, and strength to body bag 10.

Backing substrate 12 can be made of a material that includes, but is not limited to, nylon, cloth, canvas, hemp, flax, cotton fiber materials, polyethylene, polypropylene, polymer films, composite material, or any combinations thereof. A preferred embodiment of the backing substrate is a material selected from the group consisting of polyethylene, polypropylene, nylon, cotton, or any combinations thereof.

Backing substrate 12 can be partially or completely impermeable to fluids such as water, blood, body fluids, or chemicals associated with embalming or preserving a decedent's body, and serves as a fluid barrier to prevent fluids exuded by the body from contaminating the area beneath and around body bag 10 or the bearers who are carrying the body bag. Fluid impermeability of backing substrate 12 also reduces effects of outside water (from the ground or from rain and snow) from seeping into body bag 10, where such water could compromise the integrity of body bag 10 or a decedent's body therein. Backing substrate 12 may be a material that is naturally fluid-impermeable or a material that has been chemically treated to reduce liquid permeability (e.g., treated nylon or treated cloth), or a material that is coated to reduce liquid permeability, such as by urethane or a polyester. Backing substrate 12 is also preferably made of a material that resists tears or punctures, to provide ruggedness to body bag 10. Backing substrate 12 can also have a low-slip or non-slip surface, so that body bag 10 stays in position when placed on a surface.

Absorbent body 14 is connected to the first (top) side of backing substrate 12. Absorbent body 14 is typically sized less than backing substrate 12 so that a portion of the backing substrate forms an edge about a portion of absorbent body 14. Absorbent body 14 can be permanently connected to backing substrate 12, or can be removably connected (as a separate piece) to backing substrate 12. Although body bag 10 preferably has one absorbent body 14, other embodiments of body bag 10 have two or more absorbent bodies. A preferred embodiment of body bag 10, as shown in FIG. 3, has absorbent body 14 in the interior of body bag 10, and positioned on a first side of backing substrate 12, and below cover 80 and recloseable flap 104.

A preferred embodiment of body bag 10 has absorbent body 14 that is removably connected to backing substrate 12, so that the absorbent body can be replaced with a new absorbent body on the same backing substrate. An absorbent body 14 can be removably connected to backing substrate 12 by an adhesive material, where the adhesive material includes, but is not limited to, glue, tape, two-sided tape, thread, and/or an hook-and-loop interlocking device such as VELCRO® (Velcro Industries B.V. LLC Netherlands, Curacao, Netherlands Antilles).

Absorbent body 14 is made of an absorbent or superabsorbent material, and is able to absorb a large quantity of liquid, such as blood or other body fluids, or embalming chemicals, exuded from a decedent's body in body bag 10. Examples of absorbent and superabsorbent materials that can be used for absorbent body 14 include, but are not limited to, cellulose, cellulose fiber, an airlaid, an airlaid non-woven, an airlaid composite, fluff pulp, bonding fiber, superabsorbent polymer (SAP), SAP composite, compressed composite containing a percentage of short or microfiber material, thermoplastic polymer fiber, thermoplastic polymer granule, cellulose powder, cellulose gel, an airlaid with SAP, a fibrous or foam structure that has been coated or impregnated with a SAP, an absorbent structure having one or more starch or cellulose based absorbent or containing superabsorbent material formed and/or cross-linked, or any combinations thereof. Superabsorbent material used in the present disclosure can be used in various forms that include, but are not limited to, granular, fiber, liquid, superabsorbent hot melts, or any combinations thereof. A preferred embodiment of the present disclosure has a top surface or top layer of absorbent body 14 that is made of polyethylene and/or polypropylene. Another preferred embodiment has a top surface of absorbent body 14 that is made of non-woven material. Because body bag 10 is disposable, another preferred embodiment is a biodegradable absorbent or superabsorbent material. An exemplary embodiment of a biodegradable absorbent material is a starch-based absorbent material.

Absorbent body 14 can include one or more layers of absorbent or superabsorbent material. The one or more layers of absorbent material can be a top layer, a bottom layer, and/or a middle layer. Each layer of the one or more layers of absorbent body 14 can be positioned adjacent to another layer without being adhered to the next layer, or some (or all) of layers in the absorbent body can be bonded together. The one or more layers of absorbent body 14 can be bonded with an adhesive material, or by using static attraction and/or corona discharge techniques.

Absorbent body 14 can have a top layer that is a low-slip or non-slip material, or treated with a non-slip agent, to reduce movement or slipping of a decedent's body being carried in body bag 10.

Absorbent body 14 may also contain, or be treated with, a surfactant. The surfactant enhances absorption of fluids by absorbent body 14. Examples of surfactants that can be used in the present disclosure include anionic, cationic, zwitterionic, and non-ionic surfactants.

Absorbent body 14 may have one or more strengthening layers to improve the strength and/or resistance to tearing of the absorbent body. The one or more strengthening layers can be located on top of, below, or in between any portion of absorbent body 14. A strengthening layer may be made of standard non-woven material, or meltblown or spunlace composites. A preferred embodiment is a polypropylene non-woven or polypropylene/ meltblown non-woven material.

Absorbent body 14 may also contain one or more active agent, to reduce contamination by microbial pathogens, reduce odors, and/or reduce the speed of decomposition of the decedent's body. The one or more active agent can be positioned on and/or in any structure of body bag 10, preferably on and/or in absorbent body 14. The one or more active agents may be separated from another active agent by positioning among different layers in absorbent body 14, or by secreting an active agent in one or more islands within the absorbent body 14.

The active agent can be one or more bactericide, fungicide, virucide, disinfectant, sanitizer, sterilizer, mildewstat, surfactant, deodorizer, or any combinations thereof. The one or more active agent can include, but is not limited to: a metal, metal compound, surface active agent, quaternary ammonium compound, organic acid, inorganic acid, salt, sulfite, biopolymer, synthetic polymer, chitin, chitosan, nisin, enzyme, arginate, diacetate, antioxidant, or any combinations thereof. The one or more active agent can be in its active form, or, alternatively, in an inactive form that becomes activated upon contact with other agents, moisture, or fluids.

Closure 90 is preferably water-resistant, or sealed with a water-resistant sealer, to reduce leakage of blood or other body fluids from the decedent's body in body bag 10. Closure 90 can have a water-resistant sealer material 112 along its entire length, such as shown in FIG. 4 as a continuous water-resistant seal along the length of closure 90 (shown in this embodiment as a zipper). To further increase water-resistance of closure 90, the closure can have a water-resistant "landing zone" (not shown) when recloseable flap 104 is closed.

Pocket 106 is a waterproof or water-resistant pouch or bag that is connected to an interior or an exterior surface of body bag 10. As shown in FIG. 1 and particularly FIG. 3, pocket 106 is connected to the underside of flap 104 of body bag 10. Pocket 106 has outer dimensions of a size to permit a document, personal item of the decedent, forensic material, or medical equipment to be placed in the pocket and not be contaminated or moistened by liquids from the decedent's body. Typical dimensions of pocket 106 are about ten (10) inches by about thirteen (13) inches, but can be any size.

Body bag 10 is a lightweight, portable device to hold, enclose, and/or transport a decedent's body.

Alternatively, body bag 10 is a lightweight, portable device to hold, enclose and/or transport a deceased (non-human) animal.

Body bag 10 of the present disclosure is disposable. Easy disposability aids in clean up after the decedent's body is removed from the body bag, and reduces the risk of contamination and infection among persons disposing of body bag 10 after use or cleaning the surrounding area.

A "lightweight" body bag 10, as used herein, means that the body bag (including cover 80) has a total weight that is preferably less than about 4 pounds, and/or weighs less than about 150 grams/meter$^2$ (g/m$^2$), and more preferably weighs less than three-and-a-half (3.5) pounds.

The outer dimensions of an embodiment of body bag 10 are at least eighteen (18) inches in width and at least sixty-five (65) inches in length. A preferred embodiment of body bag 10 has outer dimensions that are about thirty-three and a half (33.5) inches in width by about seventy-eight (78) inches in length.

Alternative exemplary embodiments of body bags 10 of the present disclosure have smaller outer dimensions to hold and carry bodies of decedents who are children or small adults. An exemplary embodiment of body bag 10 of a smaller size has outer dimensions of about thirty-three (33) inches in width by about sixty (60) inches in length. A still smaller embodiment of body bag 10 has outer dimensions of about twenty (20) inches in width by about thirty-six (36) inches in length. A still smaller embodiment has outer dimensions of about twenty (20) inches in width by about fifteen (15) inches in length.

The smaller-dimensioned body bags 10 can also be used to hold and carry detached body parts, such as after an autopsy.

The smaller-dimensioned body bags 10 of the present disclosure can also be used to enclose and/or transport the bodies of small animals that have died, including, but not limited to, dogs, cats, birds, mice and other rodents, raccoons, squirrels, rabbits, deer, monkeys, and chimpanzees. The small body bags 10 of the present disclosure can be used for animals that are killed on roads, and research animals that have died.

A preferred embodiment of the full-sized body bag 10 is able to carry a decedent's body weighing at least 250 pounds (113.6 kilograms), more preferably able to carry a decedent's body weighing at least 300 pounds (136.4 kg), and most preferably able to carry a decedent's body weighing at least 350 pounds (159.1 kg).

Absorbent body 14 of body bag 10 can absorb a large quantity of blood and other body fluids, and chemicals associated with decedents, such as embalming fluids. The amount of fluids that can typically be absorbed by absorbent body 14 in an embodiment of body bag 10 having outer dimensions that are about thirty-three and a half (33.5) inches in width by about seventy-eight (78) inches in length (i.e., a full-size body bag) is about four-and-a-half (4.5) liters of liquids. The smaller-dimensioned body bag 10 having outer dimensions of thirty-three (33) inches in width by about sixty (60) inches in length has an absorbent body 14 that can absorb about 3.4 liters of liquids. The smaller embodiment of body bag 10 having outer dimensions of about twenty (20) inches in width by about thirty-six (36) inches in length can absorb about one-and-a-quarter (1.25) liters of liquids. The embodiment of body bag 10 having outer dimensions of about twenty (20) inches in width by about fifteen (15) inches in length is able to absorb about 0.5 liters of liquids. Total absorbency of fluids is a function of the overall size of absorbent body 14, and the necessary absorbency can be achieved by selecting the size and type of absorbent material in absorbent body 14. A typical absorbent body 14 used in body bag 10 has about one-and-three-quarters (1.75) grams of absorbency per square inch of absorbent material. However, absorbency can by adjusted to a higher or lower level simply by changing to another, higher-performance absorbent.

When not in use, body bag 10 can be folded to a compact, portable size to be easily carried by a single person.

Figure 6:
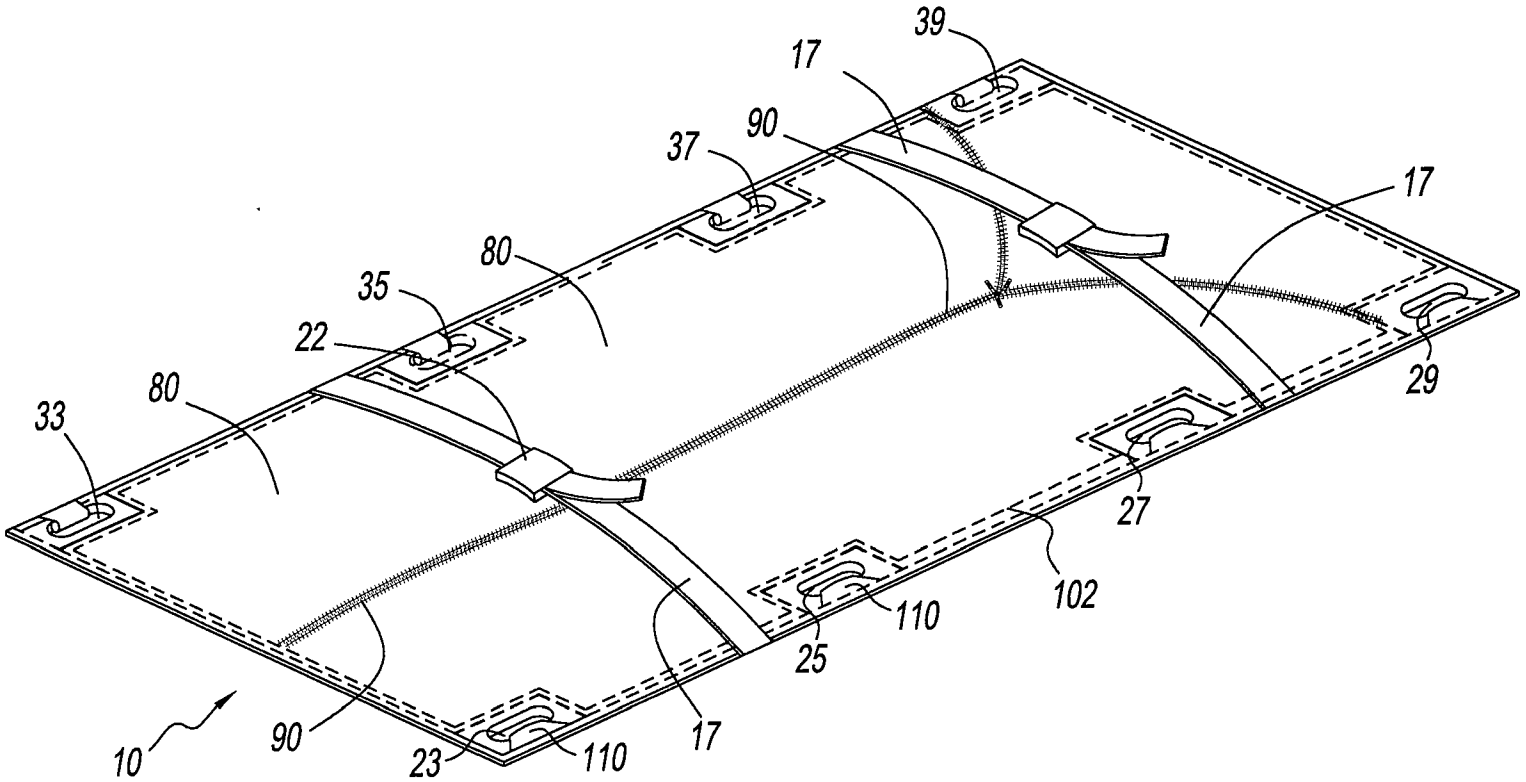
FIG. 6 shows a perspective view of another embodiment of a body bag, having a "Y"-shaped closure (closure closed).

FIG. 6 illustrates another embodiment of body bag 10, having a cover 80 with a "Y"-shaped closure 90. In this embodiment, body bag 10 has three cover segments that are connected by closure 90, shown in FIG. 6 as zippers. Gripping devices 23, 25, 27, 29, 33, 35, 37, 39 are shown, along with reinforcing pieces 110 in the gripping devices. Straps 17, with tension-adjusting devices 22, are provided to reduce movement of a decedent's body within body bag 10 and/or to secure body bag 10 in a transportation vehicle.

Figure 7:
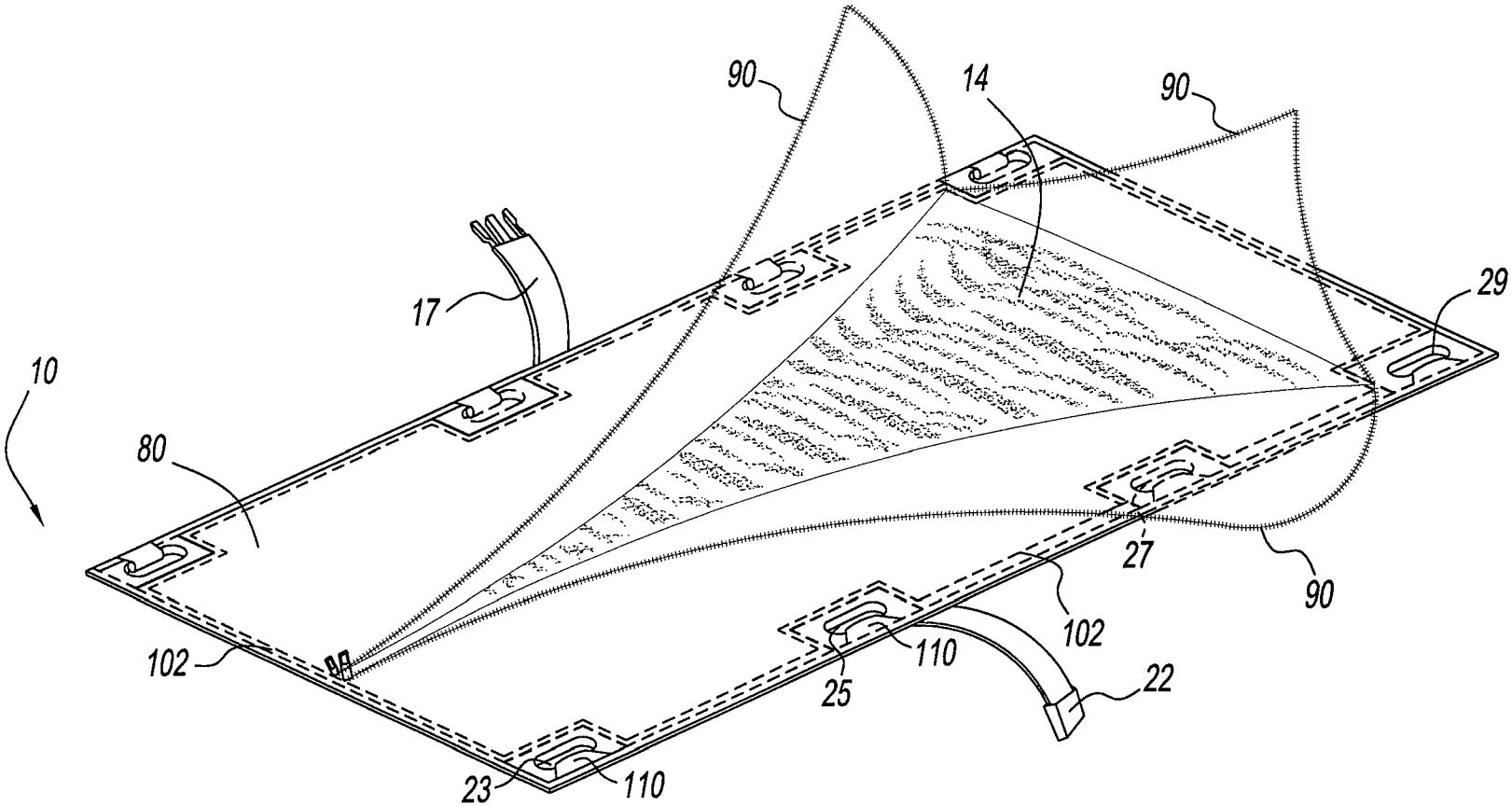
FIG. 7 shows a perspective view of the body bag in FIG. 6 (closure partially opened).

FIG. 7 shows an embodiment of body bag 10 having a single strap 17 where closures 90 are opened to display absorbent body 14 in the interior of body bag 10.

Body bag 90 can have one or more closures 90 that provide access to the interior of body bag 10. Closures 90 include, but are not limited to, zippers, hooks, snaps, adhesive tapes, buttons, hook-and-loop fasteners (e.g., VELCRO®), rib-and-groove seals (e.g., ZIPLOC®), and the like. In the embodiments shown in FIGS. 1 to 7, closure 90 is one or more zippers around recloseable flaps in either a D-shaped (envelope) or Y-shaped configuration, but closure 90 can be placed along a recloseable flap of any configuration that permits access to the interior of body bag 10. The Y-shaped configuration, for example, permits the head of the decedent's body to be accessible while the rest of the body remains covered.

Figure 8:
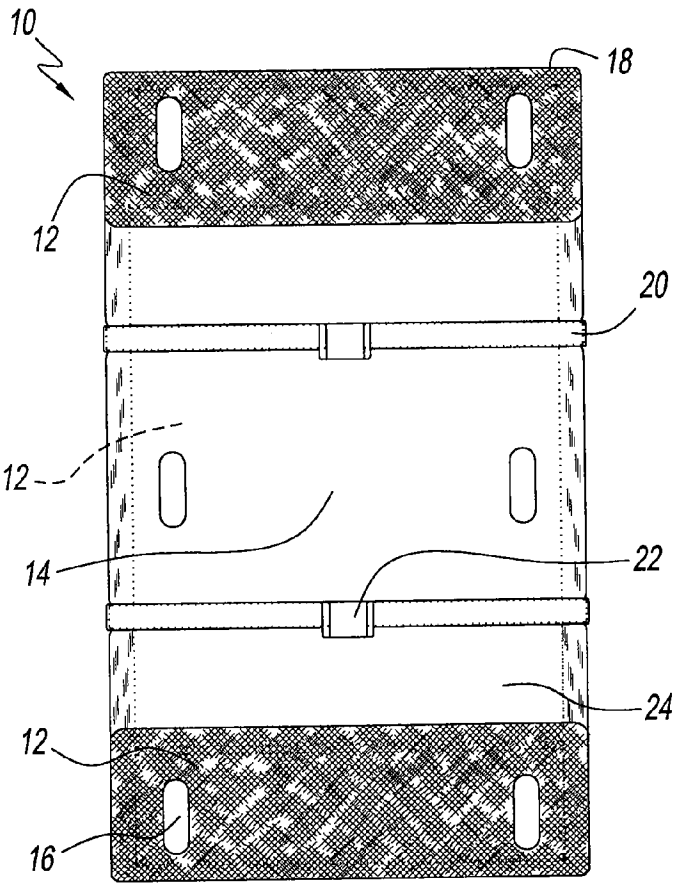
FIG. 8 is a plan view of an embodiment of the body bag of the present disclosure (shown without a cover).

FIG. 8 shows an embodiment of body bag 10 without cover 80 so that underlying features can be viewed. Body bag 10 has backing substrate 12 to form its back surface. In this embodiment, backing substrate 12 is folded over to form a top edge and bottom edge of body bag 10. Absorbent body 14 is positioned on and connected to backing substrate 12, which forms an edge about a portion of absorbent body 14. Body bag 10 has one or more gripping devices 16 positioned at the ends and/or along the sides of body bag 10, and in the embodiment shown, the gripping devices are cut through backing substrate 12 and/or absorbent body 14. Body bag 10 has a binder 18 that is connected along one or more edges of the body bag. Body bag 10 can have one or more securing strap 20 extending across the width of body bag 10, with tension-adjusting buckle 22. The embodiment of body bag 10 in FIG. 8 may be to form one or more flat panels 24, to increase the strength of body bag 10 and for ease of folding.

Binder 18 can be positioned and connected along a long edge of body bag 10 to overlay a small portion of absorbent body 14 and backing substrate 12. Binder 18 provides a defined edge to body bag 10 and reinforces the integrity and shape of the body bag when in use. As discussed before, cover 80 can be sewn flush to the outer edge of body bag 10, under finishing binder material 18, to give body bag 10 complete integrity and provide a finished appearance.

Binder 18 can be made of a webbing material, such as polyester or polypropylene, or of nylon or a nylon-based material. Binder 18 may be connected to body bag 10 with thread, adhesive or VELCRO®. Binder 18 can be attached onto the edge of body bag 10 to a width of between about one-quarter (¼) inch and about 2 inches, with a preferred width of about 1.25 inches along a long edge of body bag 10.

As shown in the embodiment in FIG. 8, securing strap 20 has tension-adjusting buckle 22. The ends of securing strap 20 are folded approximately one-and-a-half (1.5) inches to about six (6)inches under the edges of body bag 10. Securing strap 20 can be extended under body bag 10 to a dimension of about four (4) inches. There may be from zero to seven securing straps 20. Preferred embodiments have two or three securing straps 20. Securing straps 20 can be made of cloth, canvas, nylon, nylon-based material, or synthetic materials. Securing straps 20 can be placed above or beneath the binder 18, and is preferably placed beneath binder 18. Each securing strap 20 may have one or more tension-adjusting devices, such as buckle 22. Securing straps 20 may be on top of, or underneath, cover 80 (not shown in FIG. 8).

Gripping devices 16 (which are shown as gripping devices 23, 25, 27, 29, 33, 35, 37, 39 in FIGS. 1 to 7) (hereinafter gripping device 16) can be positioned anywhere along the perimeter structure of body bag 10, such as at the edges and/or along the sides of the body bag. The one or more gripping devices 16 are preferably positioned symmetrically along the ends and/or along the sides of body bag 10. Gripping device 16 may be holes (as shown) or straps, eyelet loops, or any other device passing through backing substrate 12. Each gripping device 16 permits manual gripping and lifting by a person serving as a carrier of body bag 10, or insertion of one or more rigid structures, such as poles, or any combinations of these, to enhance the ease of carrying body bag 10 with a body therein. The present disclosure provides one or more gripping devices 16. A preferred embodiment of body bag 10 has two to ten gripping devices 16 positioned at any location at body bag 10. A more preferred embodiment has four to eight gripping devices 16 that are positioned along the perimeter of body bag 10.

Each gripping device 16 can have a reinforced piece 110. Reinforced piece 110 is a separate piece of material with high-tensile properties, including, but not limited to, polyvinyl chloride, two-sided urethane-coated materials, polyesters, polypropylene, or any combinations thereof.

Body bag 10 can have one or more flat panels 24. Flat panels 24 provide additional strength to body bag 10 and permit greater ease in folding the body bag. Various folding configurations may be used for body bag 10, such as a "flat-over roll" configuration or "accordion" folding configuration, to reduce the size of the body bag when not in use and thereby enhance portability.

Figure 9:
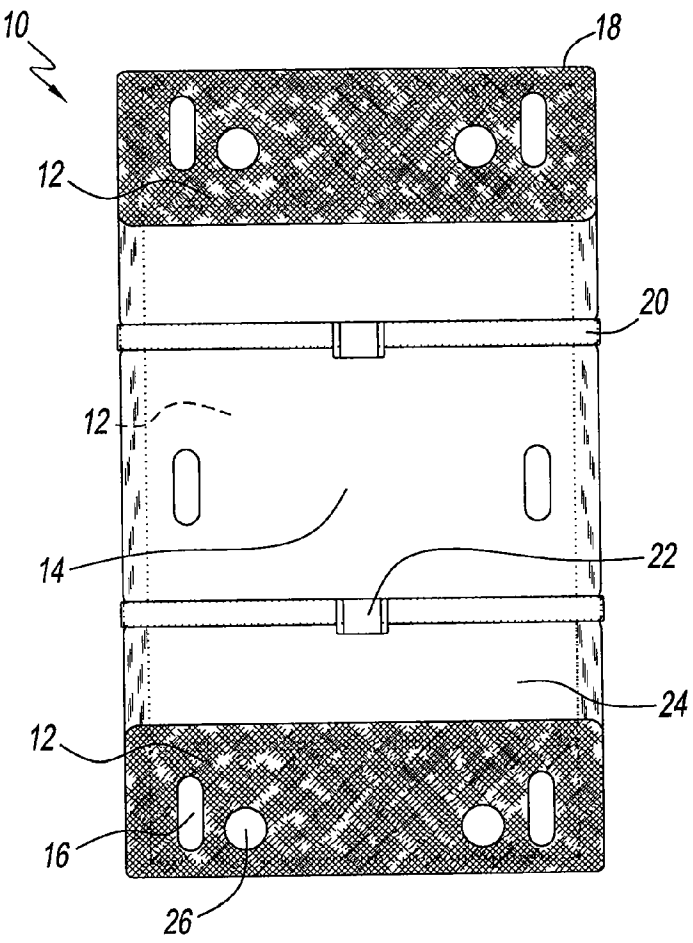
FIG. 9 is similar to the body bag in FIG. 8, shown without a cover, having circular cutouts on each end.

FIG. 9 illustrates another embodiment of body bag 10, similar to FIG. 8, without showing cover 80, having circular cutouts 26 that serve as slots through which rigid structures 28 can be inserted, or as additional gripping devices.

Figure 10:
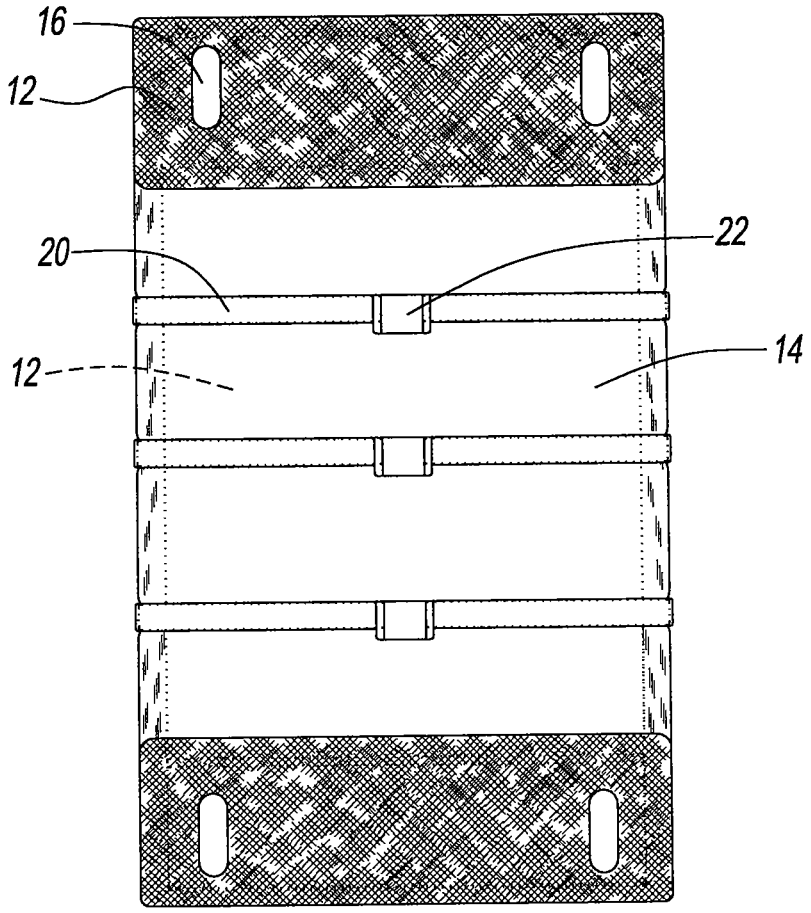
FIG. 10 is a plan view of another embodiment of the body bag of FIG. 8, shown without a cover, having three securing straps.

FIG. 10 illustrates another embodiment of body bag 10 (shown without cover 80) having three securing straps and buckles.

Figure 11:
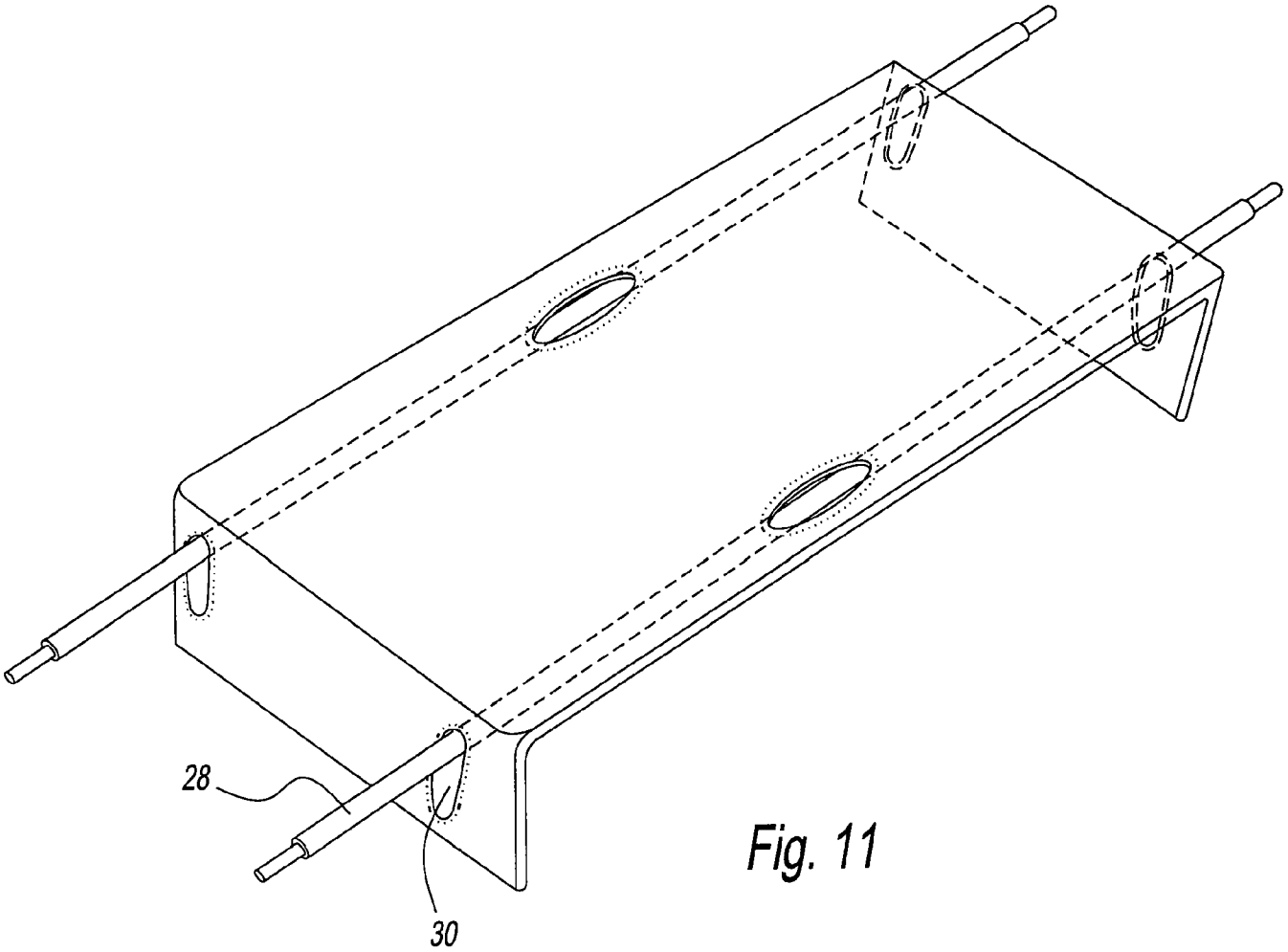
FIG. 11 is a perspective view of an embodiment of the body bag of FIG. 8 (shown without a cover) illustrating telescoping rigid poles inserted through gripping devices of the body bag.

Referring to FIG. 11, body bag 10 may be used with a rigid pole 28 that is passed through one or more gripping device 16. Rigid pole 28 can be any solid or hollow pole that can be passed through gripping device 16. Rigid pole 28 are preferably made of metal, polymer, or wood. As an example, rigid pole 28 can be a hollow polyvinyl chloride pole. Rigid pole 28 can be solid or hollow structures, depending on the need for strength and reduced weight. The cross-section of a rigid pole 28 may be any shape, with preferred embodiments having round, ovate, or flat cross-sections. As shown in the embodiment in FIG. 11, a rigid pole 28 can be "telescoping" to further enhance portability when not in use, where "telescoping" means that certain sections of the rigid pole are sized to pass inside another section, in the manner of a telescope. Additional rigid pole 28 can also be connected at other locations within, or under, the surface of body bag 10, in any direction, to provide mechanical support for the decedent's body in body bag 10. FIG. 11 illustrates an embodiment of body bag 10 with two telescoping rigid poles 28 that are metal poles inserted through certain gripping devices 16. This enables body bag 10 to be carried more easily by two or more persons acting as carriers (bearers), and provides additional support for the integrity of body bag 10.

Figure 12:
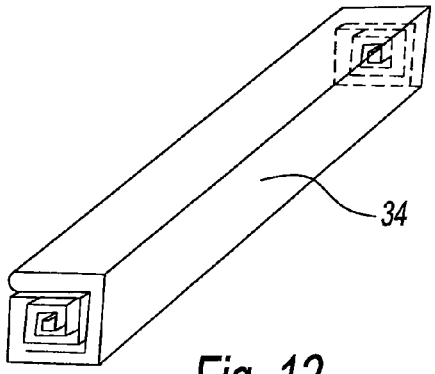
FIG. 12 is a perspective view of the body bag of FIG. 8 folded in a flat-over roll configuration.

Referring to FIG. 12, body bag 10 is foldable into a flat roll configuration 34. Folding reduces the size of body bag 10 when not in use, thereby enhancing portability and minimizing storage space. Other folding configurations, including "accordion" or "map" folding (not shown) can be used to reduce the size and volume of body bag 10. The size of body bag 10 may be further compressed by packaging under negative pressure, such as under a vacuum.

Figure 13:
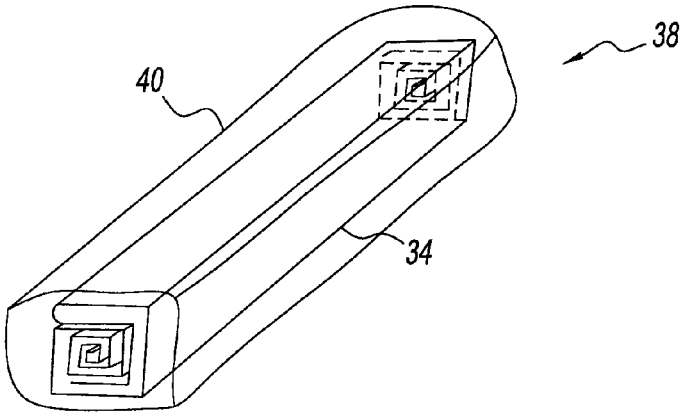
FIG. 13 is a perspective view of a kit of the body bag of FIG. 1 enclosed in a water-resistant case.

Referring to FIG. 13, a body bag kit 38 is provided having body bag 10 that is folded into a rolled configuration 34 and packaged in a case 40. Case 40 is preferably water-resistant. Case 40 can be closed and/or sealed. Once sealed, case 40 may have some or all of the air evacuated by vacuum or negative pressure to reduce the size of body bag kit 38, enhance portability, and reduce the likelihood of contamination or absorption of ambient moisture by absorbent body 14 prior to use.

Figure 14:
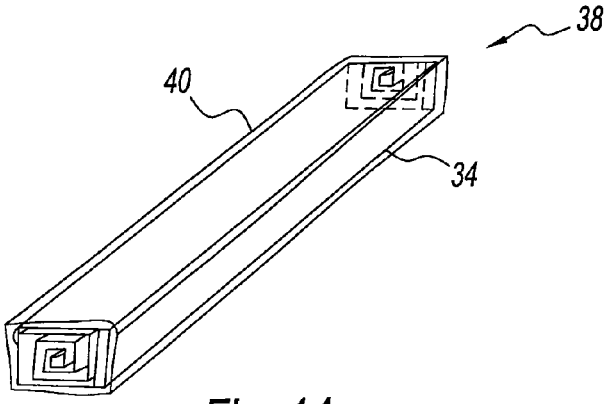
FIG. 14 is a perspective view of the kit of FIG. 13 sealed and compressed.

Referring to FIG. 14, body bag kit 38 is shown in a compressed form, where body bag 10 has been folded in configuration 34, placed within case 40, and vacuum-packaged. Removing air reduces the overall size and weight of body bag kit 38, reduces storage space requirements, and prevents absorption of ambient moisture by absorbent body 14 prior to use.

In another embodiment, body bag 10 is folded and vacuum-packaged to have outer dimensions that are about seventeen (17) inches in width by about twenty-three (23) inches in length by about three (3) inches in height, which corresponds to a volume of approximately 0.019 $m^3$. However, the folded dimensions of the body bag may range from about ten (10) inches to about twenty-four (24) inches in width, and about sixteen (16) inches to about thirty-six (36) inches in length, and about one (1) inch to about ten (10) inches in height.

Figure 15:
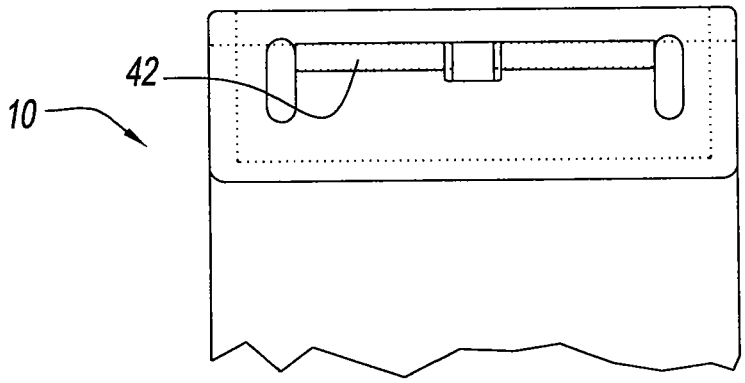
FIG. 15 is a bottom side view (cut away) of the back side of the body bag of FIG. 8, illustrating a strap across the back side of the body bag to secure the body bag to a carrying system.

FIG. 15 illustrates a bottom side view of the back side of body bag 10. One or more straps 42 can be placed across a portion of the back side of body bag 10, permitting body bag 10 to be secured to a transport vehicle, such as an ambulance or helicopter during transport. For example, strap 42 can secure body bag 10 to a TALON™-type litter during transport.

Figure 16:
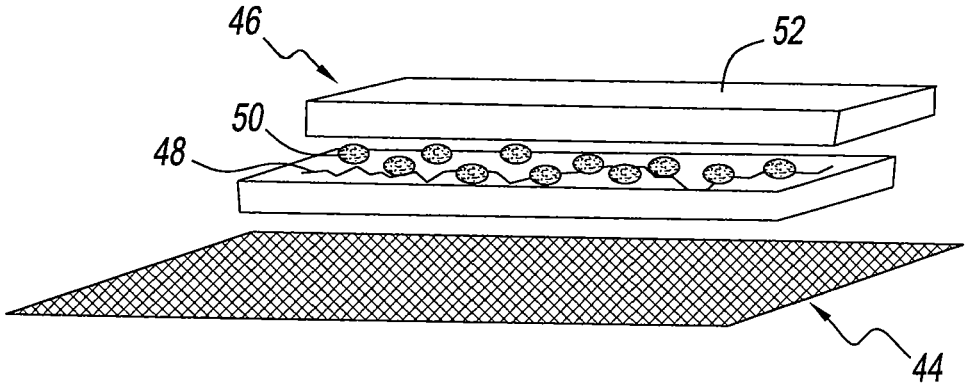
FIG. 16 is a schematic of an embodiment of an absorbent pad for the body bag of FIG. 1, illustrating an active agent between layers of material.

FIG. 16 illustrates one embodiment having an active agent in absorbent body 14 of body bag 10. Active agent 50 is disposed between two or more layers 46, 48 of absorbent body 14. In this embodiment, non-woven cover stock 52 is shown as covering the top surface of top layer 46, and a backing substrate 44, made of a material such as polyethylene, can be sized as needed. Other embodiments can have active agents disposed in more than two layers of absorbent body 14.

Figure 17:
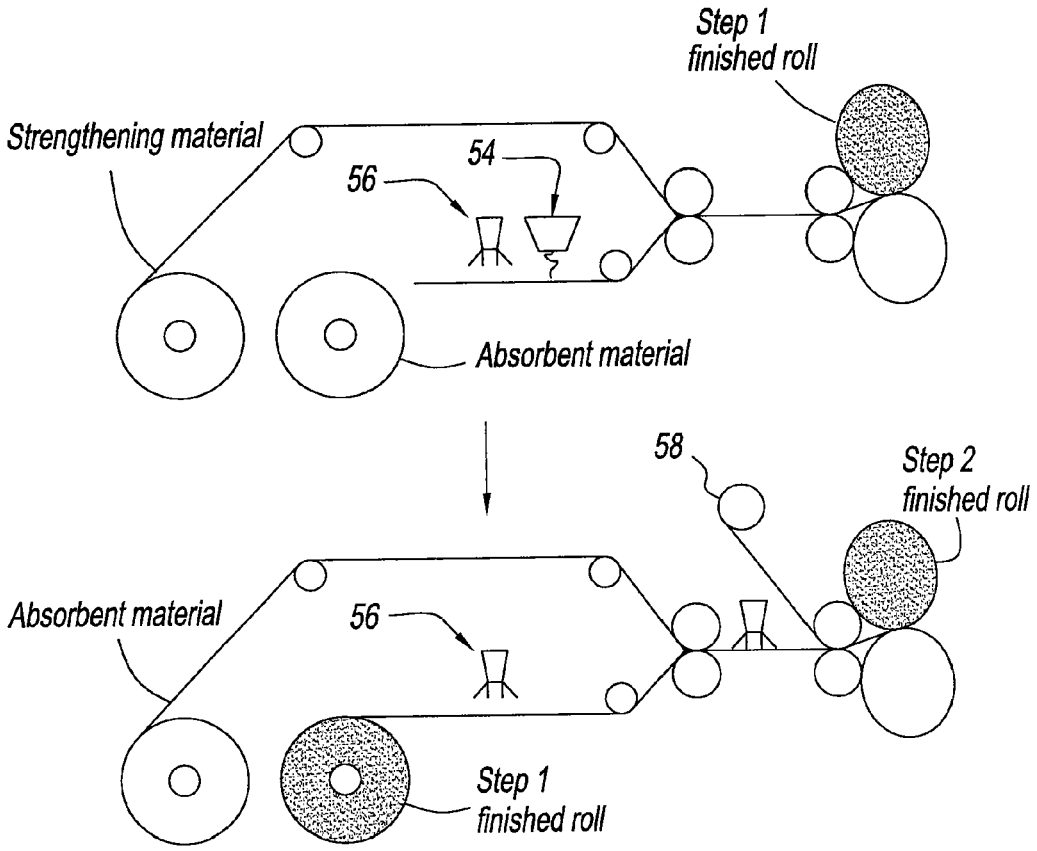
FIG. 17 is a schematic of a process to make the base materials of the body bag where the active agent is a powder.

FIG. 17 illustrates a process to combine an aspect of the absorbent body 14, a strengthening material, and an active agent, such as an antimicrobial powder. In the first step shown, a piece of absorbent material is unwound, and hot melt adhesive 56 is sprayed on the top surface. Antimicrobial powder 54 is dropped onto the adhesive layer to help bind it in place, and is covered with the strengthening material to form a finished roll, as shown. In a second step, the finished roll produced in the first step is further processed with a second absorbent core material that is bonded to it with a hot melt adhesive 56, and polyethylene backing material 58 is added. The completed roll from the second step is later converted into a finished absorbent body 14 that is used in body bag 10.

Figure 18:
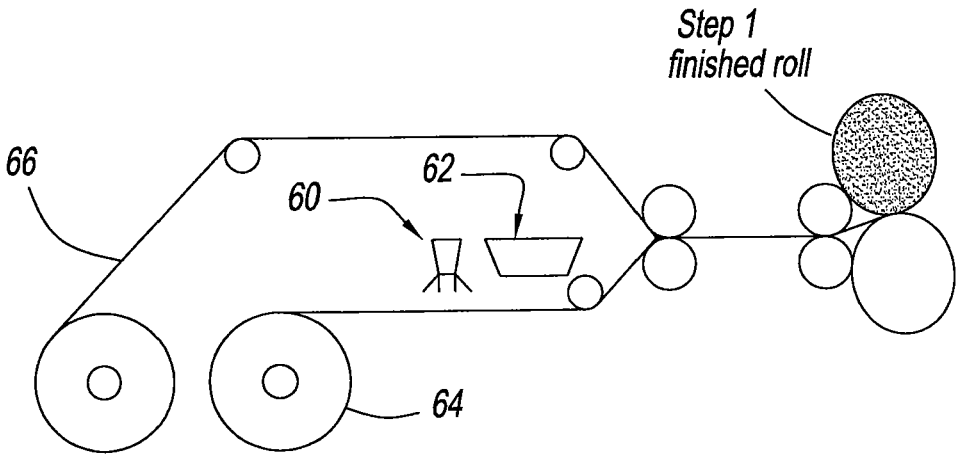
FIG. 18 is a schematic of a process to make the base materials of the body bag where the active agent is a liquid.

FIG. 18 illustrates a different process flow that generally follows the process described in FIG. 17, but uses a liquid antimicrobial instead of powder. The change from FIG. 17 occurs in the first step, where antimicrobial liquid spray 60 is used, followed by drying 62 by heat, by heated roll segments or a drying oven.

Figure 19:
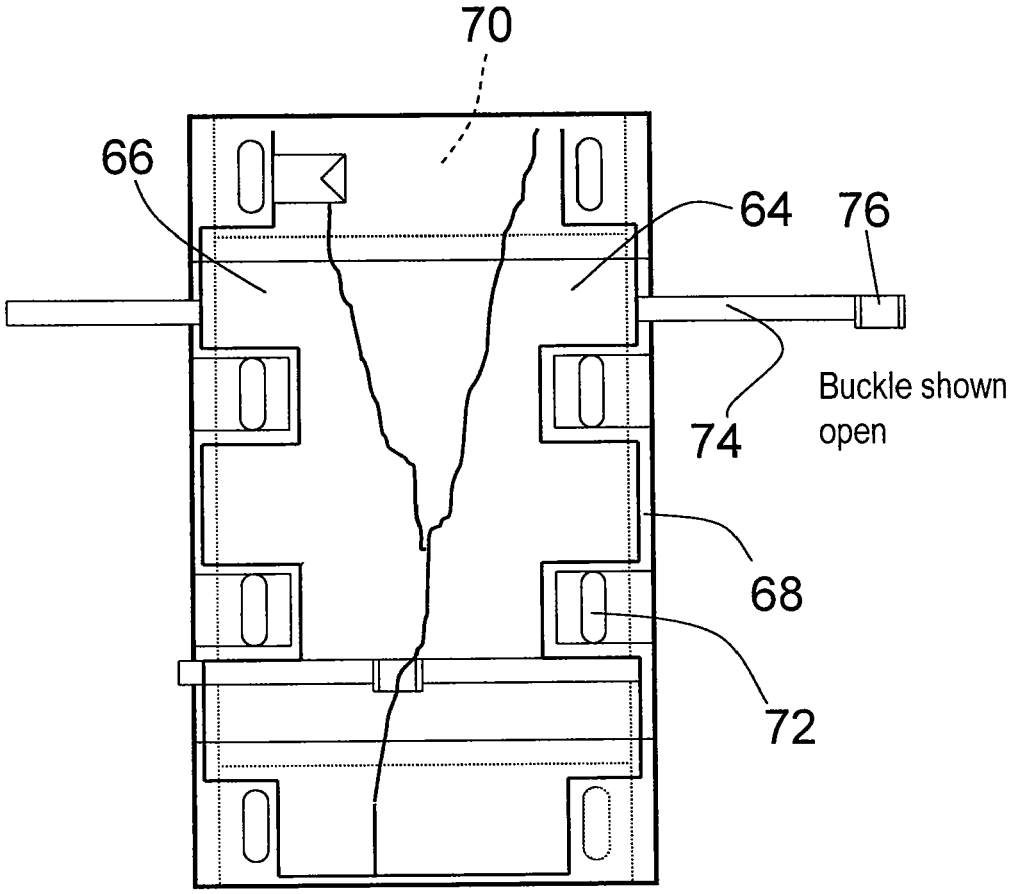
FIG. 19 is a plan view of an embodiment of a body bag having insulating layers.

Referring to FIG. 19, an embodiment of body bag 10 having insulating properties is illustrated. Two or more material segments 64, 66 (also called cover layers) are positioned on top of body bag 10 to form a cover. Material segments 64, 66 can be connected to the backing substrate 70 lengthwise along edges of body bag 10. Material segments 64, 66 may be joined by fasteners or closures 90 so as to completely enclose a decedent's body in body bag 10. For example, where the outer dimensions of body bag 10 are about seventy-eight (78) inches in length by about thirty-three and a half (33.5) inches in width, material segments 64, 66 are each about twenty-four (24) inches to about twenty-eight (28) inches wide, and more preferably each material segment 64, 66 is about twenty-six (26) inches wide. Material segments 64, 66 are shaped and connected to backing substrate 70 using stitching pattern 68 so that there is no interference with access to gripping devices 72 for the bearers of body bag 10. Stitching pattern 68 is but one embodiment of many possible stitching patterns securing material segments 64, 66 while leaving gripping devices 72 free for use. An embodiment of body bag 10 has two or more insulative material segments, forming a cover of the body bag, that are closed by closures 90.

Material segments 64, 66 overlap each other in the middle third section of the body bag so that, when a body is placed on the body bag, the material segments can be drawn up and wrapped over the decedent's body, enclosing the body and concealing it from public view. A third material segment may be connected to the top edge of body bag 10 to be drawn over to enclose the decedent's body therein. Alternatively, all material segments 64, 66 may be fully closed by closures 90.

Material segments 64, 66 may be made of any insulating material. Materials used for material segments 64, 66 include, but are not limited to, nylon/fleece combinations, GORE-TEX®, THERMO-LITE®, and CAMBRELLE®. An embodiment of body bag 10 uses material segments that each have a 2, 4. or 6-ounce fleece with 210 nylon backing. The nylon backing helps to keep water away from the body being carried.

Material segments 64, 66 are drawn up and wrapped over the body in body bag 10, and then fastening straps 74 and fastening device 76 are folded over the top of material segments 64, 66 and clipped together to secure material segments 64, 66 in their covering positions over the body in the body bag. Straps 74 and buckles 76 add strength to the structure of body bag 10, and provide additional support for the integrity of the body bag when in use. This provides greater security for the body within body bag 10, as well as securing the person within the body bag. Fastening device 76 is a buckle in FIG. 19, but can alternatively be any fastener, such as VELCRO®. In FIG. 19, the fastening device 76 and strap 74 are shown in an open position.

Backing substrate 70 in the embodiment shown in FIG. 19 also insulates body bag 10. Backing substrate 70 may be polyethylene, polypropylene, nylon, and/or composites of each material set forth herein, serves as a barrier layer to keep external weather, temperatures, wind, and wetness away from the decedent's body in body bag 10. The material used for backing substrate 70 is also preferably puncture-resistant. Puncture resistance of the backing substrate is particularly useful in those locations where the body bag is likely to be used in rugged terrain or rough surfaces, especially where a single person is carrying the body bag, where the body bag may need to be dragged along the ground. Without using puncture resistant material, a puncture or tear in the outer layer could reduce the barrier to wetness, exposing the body in body bag 10 to wetness or the weather.

Figure 20:
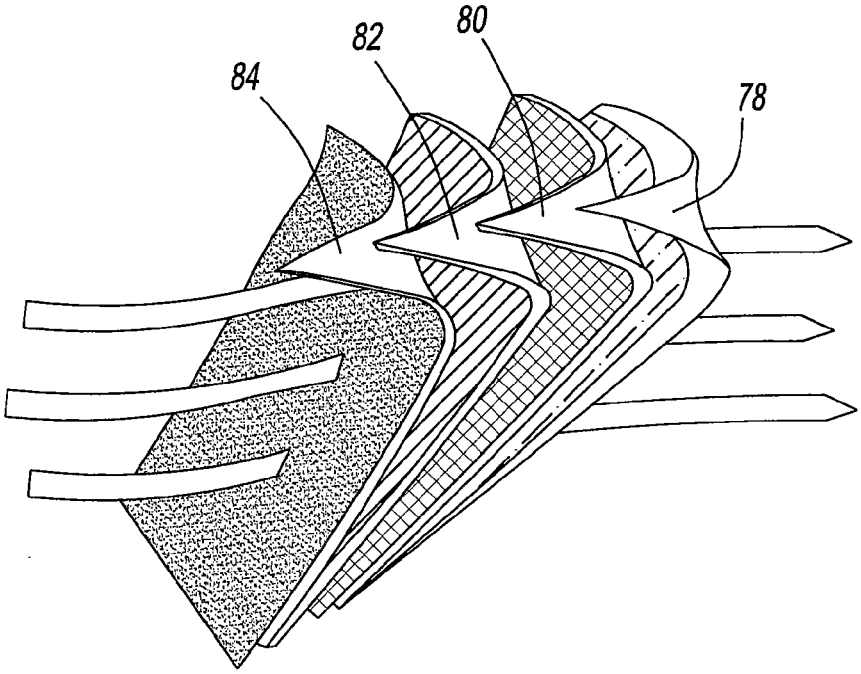
FIG. 20 illustrates layer-by-layer sections of a body bag of FIG. 19.

Referring now to FIG. 20, layer-by-layer sections of the bottom of an embodiment of body bag 10 having insulating properties is shown. An outermost layer 78 serves as a backing substrate, and can be made of polyethylene. The next inner layer is a bottom absorbent layer 81. The next inner layer is a strengthening layer 82. The top layer 84, which is closest to the body in body bag 10, is an absorbent layer.

Figure 21:
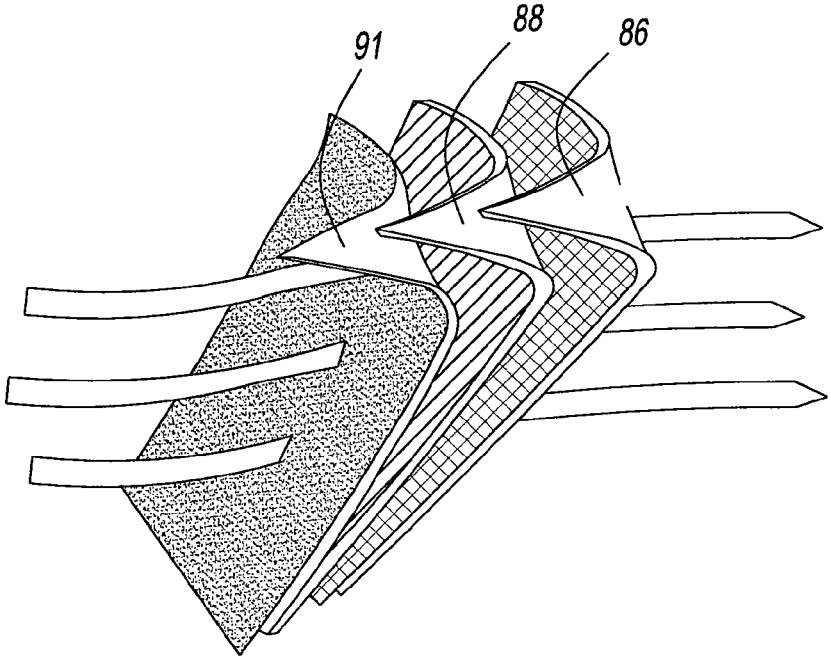
FIG. 21 illustrates the layer-by-layer sections of the cover layer (material segment) of the body bag of FIG. 19.

Referring now to FIG. 21, layer-by-layer sections of the insulating material segments of an embodiment of body bag 10 are provided. Outer layer 86 provides protection of the decedent's body from external weather and/or wetness. Various materials can be used for outer layer 86, including GORE-TEX®, 60/40 cloth, cordura, windstopper (PTFE laminate) and nylon. Middle layer 88 is mainly for insulation, and can be made of a material including fleece, pile, wool, or even thicker polyester blends of material. Middle layer 88 can be a multiple insulative layer or a single material layer. As shown in FIG. 21, middle layer 88 is a single layer of lightweight fleece material. Inner layer 91 is typically a polyester, polypropylene, or similar material that is highly vapor permeable, so that moisture is transferred or "wicked" away from the body in body bag 10 through to the next layers of structured component. As shown in FIG. 21, inner layer 91 is a polypropylene-based non-woven, to facilitate the quick wicking of moisture away from the body in body bag 10.

Body bags 10 of the present disclosure are well-suited for use for transporting bodies in mass-casualty situations, where large numbers of dead persons must be moved quickly. Body bags 10 of the present disclosure are also suitable for transporting bodies of persons who are killed during natural disasters, such as hurricanes, fires, floods, and earthquakes.

Body bags 10 of the present disclosure are also particularly well-suited for use in battlefield situations by medics and front-line troops required to rapidly move large numbers of deceased persons who may have died in hostile environments or in rough terrain. The small carrying size and light weight of body bags, and their great strength and facility for transporting a body even where body injuries were severe and accompanied by large effusions of blood and body fluids, are beneficial for such military applications. Further, the insulating properties of some embodiments may be useful where the decedent is moved from a very cold or very hot location, to help preserve the body from the external temperatures and climate, and thereby reduce decomposition of the body and undesirable odor or discoloration of the body.

Body bags 10 are likewise well-suited for moving bodies by first-response unit personnel, such as ambulances, helicopter rescue, firemen and forestry workers, where direct access to the site by traditional rescue units is difficult. The small storage volumes of the body bags, and of the body bag kits, and their light weight, make it feasible to store a large number of such body bags at locations where there are gatherings of large groups of people and thus the possibility of mass casualty or mass rescue operations, such as office buildings in large urban areas, hospitals, nursing centers, sports stadiums, and recreation areas. Body bags 10 of the present disclosure are thus particularly well-suited for first-response units, such as ambulance teams, firemen, police, Hazmat units, forestry units, and National Guard units. Examples of instances where such body bags would be of great utility include mass casualties following natural disasters, such as hurricanes, fires, epidemics, blizzards, and/or flooding, as well as man-made disasters, such as airplane accidents, train accidents, terror attacks, and/or large automobile accidents.

Also, in circumstances there are large amounts of blood and other body fluids exuded from a decedent person, absorbent body 14 of body bag 10 is able to absorb most or all of the blood and other body fluids, thereby providing a safer environment and preventing contamination of the bearers of the body bag and the vehicle. Absorbing fluids also reduces the likelihood that the body will slip around within the body bag, or that the strength and integrity of the body bag will be compromised by the body fluids.

The small weight and volume of body bag 10 make it suitable to be carried to remote locations, so that a body may be safely removed and transported.

The present disclosure also provides a method of using a body bag 10 including the following steps. Where, for example, body bag 10 is part of body bag kit 38, body bag 10 is removed from case 40, and body bag 10 is unfolded. Where the body bag is not part of body bag kit 38, body bag 10 is simply unfolded. Closure 90 is opened to permit access to the interior of body bag 10. A decedent's body is placed within body bag 10, and cover 80 is drawn over to the body. Closure 90 is closed to enclose the decedent's body. Body bag 10, with the decedent's body enclosed therein, is lifted and/or carried by one or more bearers who manually grip and lifting body bag 10 by gripping devices 23, 25, 27, 29, 33, 35, 37, 39, or by inserting rigid poles 28 through the gripping devices. This may also be achieved by a mechanical device. Body bag 10 may optionally be secured by a strap to a transportation vehicle. The bearers then transport body bag 10 with the body therein, for a desired distance.

The method of using body bag 10 may further include securing the decedent's body in the body bag by securing straps, and by adjusting the tension of the securing straps with buckles.

The body bag 10 used in this method has a backing substrate, an absorbent body, a cover, and a gripping device. The absorbent body may contain one or more active agents, including, but not limited to, antimicrobials and deodorizers. Body bag 10 encloses a decedent's body and conceals the body from public view. The absorbent body absorbs blood and other fluids to prevent bag leakage and contamination. When not in use, the body bag is lightweight and foldable to a small size for portability and ease of transport. A body bag kit includes a body bag and a water-resistant case.

Although body bag 10 and its methods of use are disclosed in reference to a deceased human body, body bag 10 may similarly be used for any (non-human) deceased animal body.

It should be understood that the foregoing description is only illustrative of the present disclosure. Various alternatives and modifications can be devised by those skilled in the art without departing from the present disclosure. Accordingly, the present disclosure is intended to embrace all such alternatives, modifications, and variances that fall within the scope of the claims.

What is claimed is:

1. A body bag for enclosing and transporting a body of a deceased human or animal, the body bag comprising:

a single body for exposure to the outside environment comprising a backing substrate and a cover, wherein said backing substrate and said cover are made of the same material that provides support to the body bag for transporting the body, said backing substrate connected to said cover proximal a perimeter of said single body, said backing substrate having a first side that faces said cover and a second side that is a bottom side of said backing substrate for exposure to the outside environment;

an absorbent body positioned on and directly connected only to said first side of said backing substrate, and being sized smaller than said backing substrate so that a portion of said backing substrate forms an edge about a portion of said absorbent body, wherein said absorbent body comprises an absorbent or superabsorbent material having a plurality of layers, and wherein said absorbent body comprises a first active agent and a second active agent that is separated from the first active agent by placing the first active agent and the second active agent in different layers of said absorbent body;

said cover having a recloseable flap that opens to provide access to the interior of the body bag and that closes to preclude access to the interior of the body bag, said recloseable flap having a closure along an edge thereof; and a gripping device along said perimeter of said single body, wherein the body bag completely encloses the body of the deceased human or animal placed therein.

2. The body bag according to claim 1, wherein said cover is connected to said portion of said backing substrate.

3. The body bag according to claim 1, wherein said cover is connected to said backing substrate along an edge of the body bag.

4. The body bag according to claim 1, further comprising a thermal seal formed between said backing substrate and said cover, wherein said thermal seal is a continuous seal around said perimeter of said single body, thereby forming a water-resistant body compartment.

5. The body bag according to claim 4, wherein said thermal seal is a thermal bond seam of between about one-quarter (¼) inch to about one (1) inch.

6. The body bag according to claim 1, wherein said closure is selected from the group consisting of: zipper, hooks, snaps, adhesive tape, buttons, hook-and-loop fasteners, rib-and-groove seals, and any combinations thereof.

7. The body bag according to claim 6, wherein said closure is sealed along its entire length with a water-resistant material.

8. The body bag according to claim 6, wherein said closure is a zipper in a configuration selected from the group consisting of: D-shape (envelope configuration) or Y-shape, and wherein said closure can be opened and closed to permit a body to be placed in, enclosed within, and/or removed from the body bag.

9. The body bag according to claim 1, wherein said material is selected from the group consisting of: nylon, nylon including composite material, treated nylon, cloth, treated cloth, canvas, hemp, flax, cotton fiber materials, polyethylene, polypropylene, polyester, polymer film, and any combinations thereof.

10. The body bag according to claim 1, wherein said backing substrate is partially or completely impermeable to water, blood, and other body fluids.

11. The body bag according to claim 1, wherein said absorbent body is removably connected to said backing substrate.

12. The body bag according to claim 1, wherein the first and the second active agents are selected from the group consisting of: bactericide, fungicide, virucide, disinfectant, sanitizer, sterilizer, mildewstat, surfactant, deodorizer, and any combinations thereof.

13. The body bag according to claim 12, wherein the first and second active agents are in an inactive form until activated by water or a fluid exuded by the body placed in the body bag.

14. The body bag according to claim 1, wherein said gripping device is selected from the group consisting of a hole, strap, eyelet loop, and any combinations thereof.

15. The body bag according to claim 1, wherein said gripping device is two or more gripping devices, and further comprising a rigid body that can be passed through the two or more gripping devices.

16. The body bag according to claim 1, wherein said body bag has a weight that is less than about 150 grams per square meter ($g/m^2$).

17. The body bag according to claim 1, wherein said body bag has a strength sufficient to carry a person weighing at least 250 pounds (113.6 kilograms).

18. A body bag according to claim 1, wherein the body bag has outer dimensions of less than about thirty-three (33) inches in width by about sixty (60) inches in length, wherein the body bag is proportioned for decedents who are children or young adults.

19. A body bag according to claim 1, wherein the body bag has outer dimensions in proportion to the size of bodies of animals selected from the group consisting of: dog, cat, mouse, bird, squirrel, rabbit, raccoon, deer, monkey, and chimpanzee.

20. A body bag according to claim 1, wherein said backing substrate and said cover are substantially planar.

21. A body bag according to claim 1, wherein said absorbent body is adjacent to said cover.

22. A method for using a body bag to enclose and carry a decedent's body, comprising:

opening the body bag, wherein the body bag comprises:

a single body for exposure to the outside environment comprising a backing substrate and a cover, wherein said cover is connected to said backing substrate proximal a perimeter of said single body, wherein said backing substrate and said cover are made of the same material that provides support to the body bag for carrying the decedent's body, said backing substrate having a first side that faces said cover and a second side that is a bottom side of said backing substrate for exposure to the outside environment;

an absorbent body positioned on and directly connected only to said backing substrate, wherein said absorbent body is smaller than said backing substrate, wherein said absorbent body comprises an absorbent or superabsorbent material having a plurality of layers, wherein said absorbent body comprises a first active agent that is separated from a second active agent by placing said first active agent and said second active agent in different layers of said absorbent body;

said cover having a recloseable flap and a closure along an edge of said recloseable flap; and a gripping device along a perimeter of said backing substrate;

opening said closure and said recloseable flap to provide access to an interior of the body bag;

placing the decedent's body in the body bag;

closing said recloseable flap and said closure such that the body bag completely encloses the decedent's body placed therein; and transporting the decedent's body via the body bag.

23. A method according to claim 22, wherein said backing substrate and said cover are substantially planar.

24. A method according to claim 22, wherein said absorbent body is adjacent to said cover.

25. A method according to claim 24, wherein the decedent's body is adjacent to said absorbent body.

26. A body bag kit comprising:

a body bag adapted to enclose and conceal a body and be exposed to the outside environment, the body bag comprising:

a backing substrate and a cover, said cover being connected to said backing substrate proximal a perimeter of the body bag, wherein said backing substrate and said cover are made of the same material that provides support to the body bag for transporting the body, said cover adapted to be exposed to the outside environment and having a recloseable flap and a closure along an edge of said recloseable flap;

an absorbent body positioned on and directly connected only to said backing substrate, wherein said absorbent body is smaller than said backing substrate, wherein said absorbent body comprises an absorbent or superabsorbent material having a plurality of layers, and wherein said absorbent body comprises a first active agent that is separated from a second active agent by placing said first active agent and said second active agent in different layers of said absorbent body; and a gripping device along a perimeter of said backing substrate; and a water-resistant container that completely envelops the body bag when the body bag is not in use.

27. A kit according to claim 26, wherein, when the body bag is removed from said container, said backing substrate and said cover are substantially planar.

28. A kit according to claim 26, wherein said absorbent body is adjacent to said cover.

* * * * *